US006195852B1

(12) United States Patent
Kusayama

(10) Patent No.: US 6,195,852 B1
(45) Date of Patent: Mar. 6, 2001

(54) REVERSELY OPENABLE BOTTOM END STOP OF SLIDE FASTENER

(75) Inventor: Masahiro Kusayama, Toyama-ken (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 09/396,148

(22) Filed: Sep. 15, 1999

(30) Foreign Application Priority Data

Sep. 30, 1998 (JP) ..... 10-278600

(51) Int. Cl.[7] ..... A44B 19/38
(52) U.S. Cl. ..... 24/434
(58) Field of Search ..... 24/433, 434, 386, 24/388

(56) References Cited

U.S. PATENT DOCUMENTS 3,663,996 * 5/1972 Heimberger et al. .
3,892,017 7/1975 Watson .
4,312,103 * 1/1982 Akashi .
5,638,585 * 6/1997 Mizuno .
5,755,014 * 5/1998 Yamaguchi et al. .
5,791,023 * 8/1998 Comerford .

FOREIGN PATENT DOCUMENTS 0 704 177 4/1996 (EP) .
2 022 687 12/1979 (GB) .
2 032 998 5/1980 (GB) .
61-44647 3/1986 (JP) .

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

The present invention provides a reversely openable bottom end stop, wherein the bottom end stop can be easily held and smooth reverse opening or bottom end stop operation can be carried out. An upward opening type or a both-way opening type of slide fastener can be supplied in immediate response to demand. In the bottom end stop, reinforcing portions are formed by welding thermoplastic resin films or the like to end portions of fastener tapes, a box pin and a separable pin are molded at inner edges of the reinforcing portions, thin guide portions having such widths that flanges of a slider can slide in the guide portions are molded in adjacent to the box pin and the separable pin, reinforcing streak portions lower than the box pin or the separable pin and in a shape of a rectangular parallelepiped are molded in adjacent to the guide portions, and a V-shaped stopper of a slider extending from a tip end of the box pin and a tip end of the reinforcing streak portion and being lower than the box pin and higher than the reinforcing streak portion is molded on a face of the guide portion. According to the demand, a box or the slider for reverse opening is mounted to form the upward opening type or the both-way opening type of slide fastener.

7 Claims, 7 Drawing Sheets

REVERSELY OPENABLE BOTTOM END STOP OF SLIDE FASTENER

BACKGROUND OF THE INVENTION

1. Field of the Invention

The present invention relates to an open type of slide fastener which can immediately double as a slide fastener having a bottom end stop for upward opening or as a slide fastener having a bottom end stop for both-way opening by using a box or a slider for reverse opening in a bottom end stop of a slide fastener.

2. Description of the Related Art

As this type of conventional open type of slide fastener, there is a reversely openable bottom end stop as disclosed in Japanese Utility Model Publication No. 55-44494, wherein reinforcing plates 108 made of plastic are formed at end portions of left and right fastener stringers 101, a box pin and a separable pin 104 are respectively mounted to side ends of the reinforcing plates 108, a protuberant portion 130 is formed on an upper face of the box pin 103, a projection is formed at a lower end of the protuberant portion 130, a rectangular fitting recessed portion 133 is formed on the reinforcing plate 108 on a side of the box pin 103, a partitioning plate 132 is formed at a side face of a box 118 and fitted in the fitting recessed portion 133 of the reinforcing plate 108, a recess stepped portion 131 is formed at an outer end of a back face of an upper plate of the box 118, and the projection formed at the lower end of the box pin 103 is fitted in the recess stepped portion 131, thus fixing the box pin 103 and the box 118, for example, as shown in FIG. 11.

Furthermore, there is a bottom end stop for reverse opening and made of thermoplastic resin as disclosed in Japanese Utility Model Publication No. 61-44647, wherein a stopper 7' projecting in an L shape is integrally molded with an end portion of an outer side edge portion 25' at a side of a box pin 3' such that a tip end of a flange 17' of a slider for reverse opening 16' can abut on the stopper 7', as shown in FIG. 12.

In the reversely openable bottom end stop described above and shown in FIG. 11, the box pin 103 and the box 118 of the bottom end stop are fixed to each other by fitting the lower end of the partitioning plate 132 formed on the side face of the box 118 in the fitting recessed portion 133 formed on the reinforcing plate 108 on the side of the box pin 103 and by fitting the projection formed on the upper face of the box pin 103 in the recess stepped portion 131 formed on the back face of the upper plate of the box 118. However, because a fixing mechanism is merely fitting means, the fixing mechanism is unstable and may be broken under rough use. When the bottom end stop is used as the bottom end stop for reverse opening, a slider used for reverse opening has to be a specific slider defined at a back face of an upper wing plate of the slider with the recess stepped portion to be fitted over the projection formed on the upper face of the box pin. Therefore, when the bottom end stop is applied to a reverse-opening type of product, a slider of the same type as a normal slider, i.e., a slider for upward opening can not be used.

Next, because the bottom end stop shown in FIG. 12 is intended for reverse opening, the bottom end stop can not immediately respond to the bottom end stop to which the box 118 is attached. Moreover, because the outer side edge portions 25' on the sides of the box pin 3' and a separable pin 4' are flat, it is difficult to hold the fastener chain in a bottom end stop operation and a smooth operation can not be expected.

SUMMARY OF THE INVENTION

The present invention has been accomplished with the above-described problems in view and it is a main object of the invention to provide a reversely openable bottom end stop of a slide fastener wherein a both-way opening type of slide fastener and an upward opening type of slide fastener can be supplied in immediate response to demand. In each of the slide fasteners, a portion of a fastener chain where the bottom end stop is disposed can be easily held, reverse opening operation or bottom end stop operation can be carried out smoothly, and the slider for reverse opening can be stopped properly.

An object of the invention is to provide a reversely openable bottom end stop of a slide fastener, wherein the slider for reverse opening reliably guides the bottom end stop at an end of the fastener chain in a closing direction, i.e. sideways, a stopping function of the slider for reverse opening is improved, and an end portion has favorable appearance.

Another object of the invention is to provide a reversely openable bottom end stop of a slide fastener having guide portions which are for smooth sliding of the slider for reverse opening and do not hinder mounting of the box.

An object of the invention is to provide a reversely openable bottom end stop of a slide fastener, wherein mounting operation of a box is facilitated such that the box can be easily inserted into the box pin and a stopping function of the slider for reverse opening is not hindered.

The invention has an object to provide a reversely openable bottom end stop, wherein a portion of a fastener chain to which the bottom end stop is mounted is reinforced, the end portion of the fastener chain can be easily held, a smooth bottom end stop operation can be carried out, and the bottom end stop is suitable to a slide fastener of a type wherein a fastener element is mounted to one face of the fastener tape.

It is an object of the invention to provide a reversely openable bottom end stop, wherein a portion of a fastener chain to which the bottom end stop is mounted is reinforced, the end portion of the fastener chain can be easily held, a smooth bottom end stop operation can be carried out, and the bottom end stop is suitable to a slide fastener of a type wherein a fastener element is mounted to project from opposite faces of each the fastener tape.

Another object of the invention is to provide a slide fastener mounted with a bottom end stop, wherein the box is firmly fixed to an end portion of a fastener stringer.

It is an object of the invention to provide a slide fastener mounted with a bottom end stop, wherein the slider for reverse opening and the slider for upward opening are employed.

To achieve the above objects, according to the first aspect of the invention, there is provided a reversely openable bottom end stop of a slide fastener, wherein a box pin 3 and a separable pin 4 are respectively molded on end portions of fastener stringers 1, 1 by injection molding or extrusion means by using thermoplastic resin, thin guide portions 5 are respectively and integrally molded at sides of the box pin 3 and the separable pin 4, projecting reinforcing streak portions 6 are integrally molded at sides of the guide portions 5, and a stopper 7 extending from a tip end of the box pin 3 to a tip end of the reinforcing streak portion 6 and is integrally molded on an upper face of the guide portion 5.

Preferably, the stopper 7 laterally formed between the box pin 3 and the reinforcing streak portion 6 is in a V shape and projecting higher than the reinforcing streak portion 6, and the reinforcing streak portion 6 is integrally molded to project from both front and back surfaces of a fastener tape 2.

Further preferably, the thin guide portions 5 formed at the sides of the box pin 3 and the separable pin 4 are integrally molded between the box pin 3 and the reinforcing streak portion 6 and between the separable pin 4 and the reinforcing streak portion 6 to have such widths that at least flanges 17 of a slider 16 can slide in the guide portions 5.

Still preferably, the stopper 7 laterally formed between the box pin 3 and the reinforcing streak portion 6 is defined at an intermediate portion of the stopper 7 with a stepped portion 10 and projects higher on a reinforcing streak portion 6 side and lower on a box pin 3 side.

Yet preferably, reinforcing portions 8 are formed by welding thermoplastic resin films to opposite faces of end portions of the pair of fastener tapes 2 by ultrasonic machining or the like, the reinforcing streak portions 6 are formed on both front and back surfaces of the reinforcing portions 8 of the left and right fastener stringers 1, and the box pin 3, the guide portion 5, and the stopper 7 are integrally molded on a surface of the reinforcing portion 8 of the one fastener stringer 1, and the separable pin 4 and the guide portion 5 are integrally molded on a surface of the reinforcing portion 8 of the other fastener stringer 1.

Further preferably, reinforcing portions 8 are formed by welding thermoplastic resin films to opposite faces of end portions of the pair of fastener tapes 2 by ultrasonic machining or the like, the box pin 3, the guide portion 5, the stopper 7, and the reinforcing streak portion 6 are integrally molded on both front and back surfaces of the reinforcing portion 8 of the one fastener stringer 1 so as to be symmetric with respect to a fastener tape plane, and the separable pin 4, the guide portion 5, and the reinforcing streak portion 6 are integrally molded on both front and back surfaces of the reinforcing portion 8 of the other fastener stringer 1 so as to be symmetric with respect to the fastener tape plane.

Still preferably, a box 18 is substantially square and defined at a center of the box 18 with a partitioning portion 19, a box pin insertion hole 22 is formed at one side of the partitioning portion 19, a separable pin insertion hole 23 is formed at the other side of the partitioning portion 19, a streak of inserting groove 21 for the fastener tape 2 is formed at a side portion of each of the box pin insertion hole 22 and the separable pin insertion hole 23, a locking hole 24 which is for the stopper 7 and is wider than the inserting grooves 21 is connected to a tip end of the inserting groove 21 of the box pin insertion hole 22, the box pin 3 is fitted into the box 18, the stopper 7 is locked in the locking hole 24 of the box 18, and opposed faces of the box 18 and the box pin 3 are welded to each other by ultrasonic machining or the like.

Preferably, the slider 16 for reverse opening and the slider 16 for upward opening are slid and fitted over the fastener stringer 1 mounted with the box pin 3 reversely to each other, i.e., to face each other reversely, and a tip end of the flange 17 of the slider 16 for reverse opening can abut on the stopper 7 formed to project from a face of the guide portion 5.

DESCRIPTION OF THE PREFERRED EMBODIMENTS

Embodiments of a reversely openable bottom end stop of a slide fastener of the present invention will be specifically described below by reference to the drawings.

Figure 1:
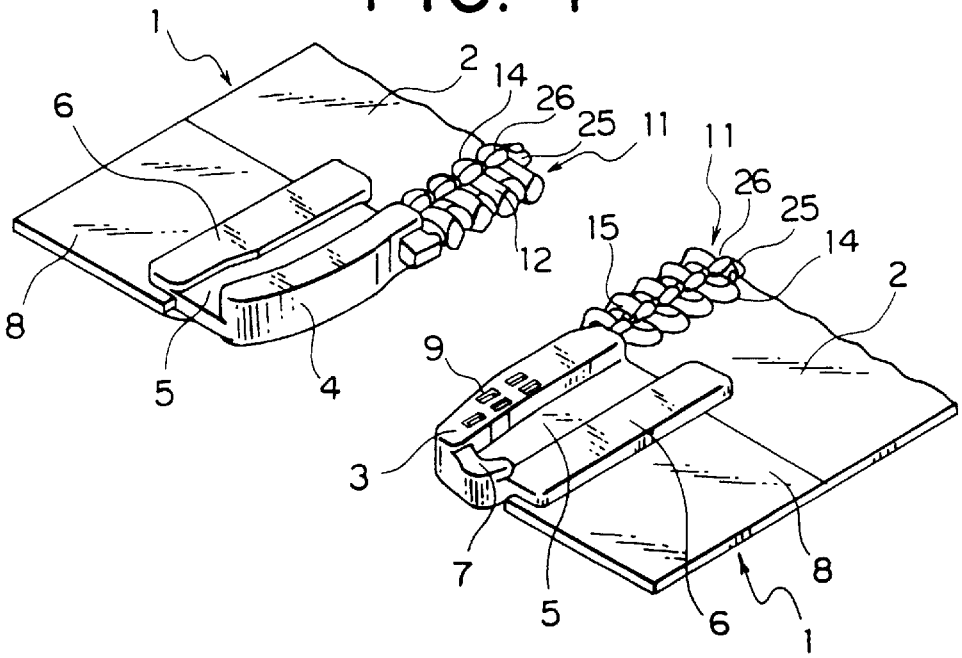
FIG. 1 is a perspective view of a reversely openable bottom end stop.

The bottom end stop of the invention can double as a bottom end stop for reverse opening. As shown in FIG. 1, left and right fastener stringers 1, 1 are formed with reinforcing portions 8 by welding thermoplastic resin films made of polyamide, polyethylene, or the like or laminated thermoplastic resin films to fastener tapes 2 by ultrasonic machining or by causing thermoplastic resin liquid to permeate the fastener tapes 2 and hardening the liquid to firmly fix and reinforce end portions of the fastener tapes 2 in order to mold a box pin 3 and a separable pin 4 respectively on the end portions of the fastener tapes 2.

A reinforcing process is carried out as follows. A coil-shaped fastener element 12 is sewn on a longitudinal edge portion of each the fastener tape 2 by using a sewing yarn 26. The coil-shaped fastener element 12 is formed from a monofilament which is a synthetic fiber made of polyamide, polyester, or the like. A tip end portion of the coil-shaped fastener element 12 is cut and removed from the fastener tape 2 and each the reinforcing portion 8 is molded such that the thermoplastic resin film envelops a core thread 25 and the sewing yarn 26 remaining at the cut portion.

An inner side of each the reinforcing portion 8, i.e., a tip end of the reinforcing portion 8 on a side of the coil-shaped fastener element 12 is notched to a proper size and the box pin 3 or the separable pin 4 is molded at the notched portion. The box pin 3 is a rectangular parallelepiped, has substantially the same height as the coil-shaped fastener element 12, and substantially accords with outer sides of connecting portions 14 of the coil-shaped fastener element 12. A side end of the box pin 3 substantially accords with a longitudinal edge of the fastener tape 2. A thin guide portion 5 which is adjacent to a side of the box pin 3 and has such a width that a flange 17 of the slider 16 can freely slide in the guide portion 5 is molded. A reinforcing streak portion 6 in a shape of a rectangular parallelepiped which projects from front and back faces of the fastener tape 2 and is lower than the box pin 3 is molded in adjacent to a side of the guide portion 5 and in parallel to the box pin 3. A V-shaped stopper 7 extending from a tip end of the box pin 3 and a tip end of the reinforcing streak portion 6 and lower than the box pin 3 and higher than the reinforcing streak portion 6 is molded on an upper face of the guide portion 5.

A plurality of small projections 9 are formed to project from half of the tip end side portion of an upper face of the box pin 3. The small projections 9 are molded to have such a height that a slider 16 for reverse opening can slide freely without hindrance and are formed to be melted and joined to a box 18. The tip end of the box pin 3 bends slightly inward to guide a flange 20 of the box 18 or the flange 17 of the slider 16 for reverse opening sideways.

The box pin 3, the guide portion 5, the reinforcing streak portion 6, and the stopper 7 are integrally molded by injection molding processing or extrusion processing by using thermoplastic rein such as polyacetal, polyamide, polypropylene, polybutyrene terephthalate, or the like.

On the other hand, similarly to the box pin 3, a portion of the reinforcing portion 8 formed at the end portion of the fastener tape 2 by removing the coil-shaped fastener element 12 is notched and the separable pin 4 in a shape of a rectangular parallelepiped is molded at the notched portion to have substantially the same height as the coil-shaped fastener element 12 and to substantially accord with outer sides of connecting portions 14 of the coil-shaped fastener element 12. A side end of the separable pin 4 substantially accords with a longitudinal edge of the fastener tape 2. A thin guide portion 5 which is adjacent to a side of the separable pin 4 and has such a width that a flange 17 of the slider 16 can freely slide in the guide portion 5 is molded. A reinforcing streak portion 6 in a shape of a rectangular parallelepiped which projects from front and back faces of the fastener tape 2 and is lower than the separable pin 4 and higher than the guide portion 5 is molded in adjacent to a side of the guide portion 5 and substantially in parallel to the separable pin 4.

A tip end of the molded separable pin 4 bends slightly inward and a wall of the reinforcing streak portion 6 facing the separable pin 4 is slightly recessed such that the tip end and the opposite wall can be easily fitted in the box 18 or the slider 16 for reverse opening. The separable pin 4, the guide portion 5, and the reinforcing streak portion 6 are integrally molded by injection molding processing or extrusion processing by using thermoplastic resin similar to that for the above-described box pin 3 and the like.

Figure 2:
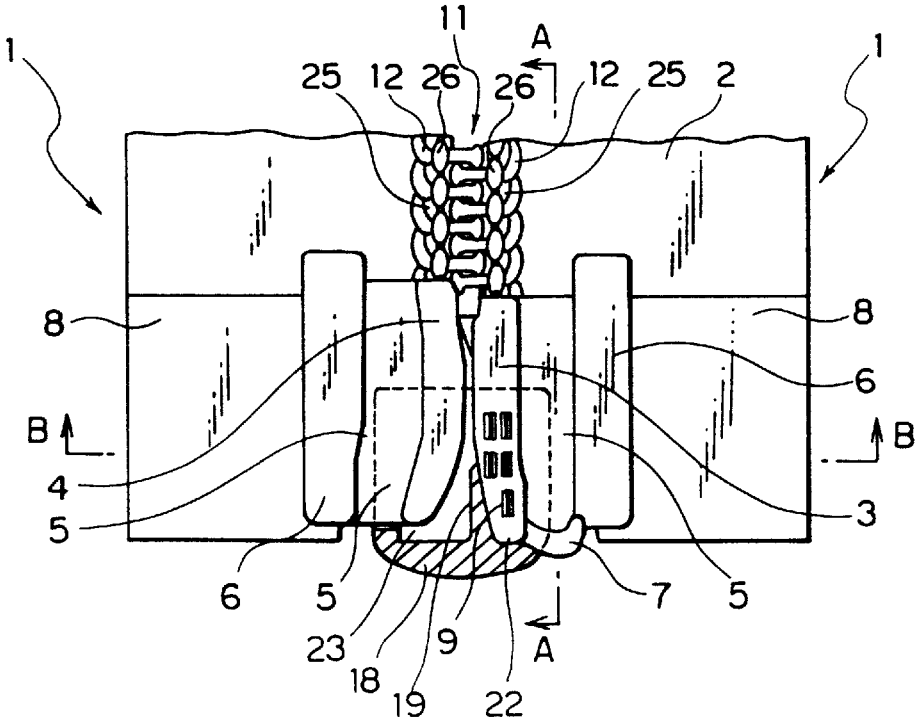
FIG. 2 is a front view of a reversely openable bottom end stop equipped with a box with a portion cut.
Figure 3:
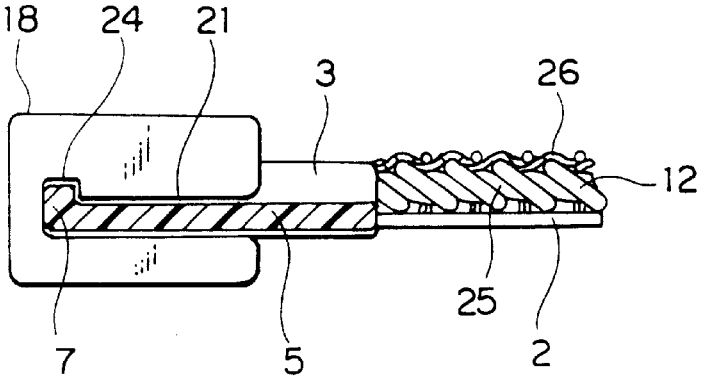
FIG. 3 is a sectional view taken along a line A—A in FIG. 2.
Figure 4:
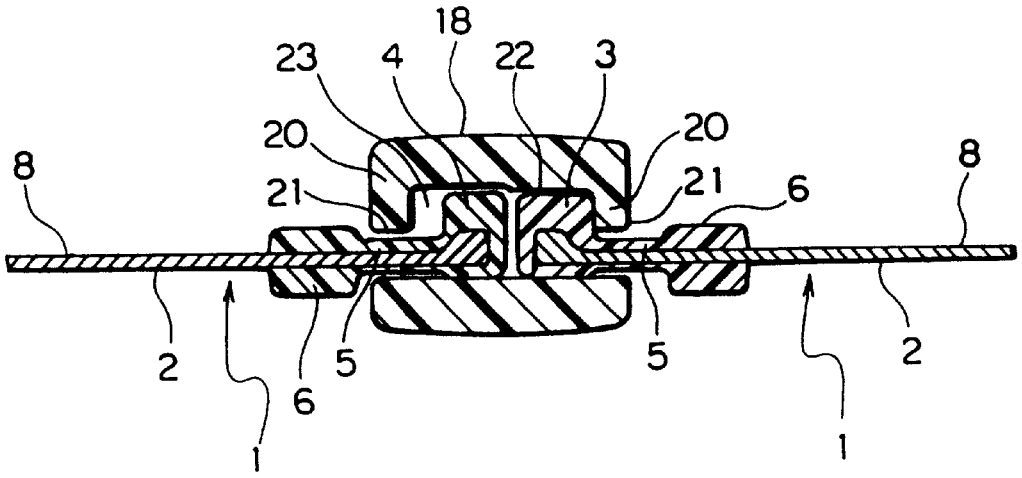
FIG. 4 is a sectional view taken along a line B—B in FIG. 2.

As shown in FIGS. 2 to 4, the box 18 fitted over the box pin 3 has an outward form which is substantially a square and the fastener tapes 2 can be inserted into the flanges 20 on opposite sides of the box 18. The box 18 is defined with inserting grooves 21 slightly narrower than a thickness of the stopper 7, a partitioning portion 19 at a center of the box 18, and a box pin insertion hole 22 and a separable pin insertion hole 23 on the left and right of the partitioning portion 19. A locking hole 24 extending toward a surface of the box 18 is formed at a deepest portion of the inserting groove 21 of the flange 20 in the box pin insertion hole 22. The locking hole 24 is formed such that the stopper 7 formed to project from the upper face of the guide portion 5 and extends from the box pin 3 to the reinforcing streak portion 6 can be fitted into the locking hole 24.

It is also possible to form some streaks of small projecting portions on a ceiling portion of the box pin insertion hole 22 of the box 18 such that the small projecting portions can be welded to the box pin 3. In this case, if the small projecting portions 9 are not formed on the upper face of the box pin 3, the box 18 and the box pin 3 can be ultrasonically welded to each other.

Mounting means of the box 18 to the box pin 3 is as follows. The box pin 3 is put to the box pin insertion hole 22 of the box 18, the stopper 7 projecting from the end portion of the guide portion 5 is put to the inserting groove 21 formed in the flange 20 of the box pin insertion hole 22, the box 18 is pushed and inserted while opening up the inserting groove 21 by force. After the locking hole 24 formed at the deepest portion of the inserting groove 21 is fitted over the stopper 7 to fix the box 18, the small projections 9 formed to project from the upper face of the box pin 3 are welded to the box 18 by applying ultrasonic machining to the surface of the box 18. Thus, the box 18 is firmly fixed to the box pin 3 and the bottom end stop is completed.

A bottom end stop operation of the slide fastener is as follows. The slider 16 for upward opening is slid and put to the box 18 fixed to one of the fastener stringers 1. Then, the reinforcing streak portion 6 mounted to the other fastener stringer 1 is held to insert the separable pin 4 from a shoulder opening of the slider 16 for upward opening. After inserting the separable pin 4 to the separable pin insertion hole 23 of the box 18, the slider 16 for upward opening is slide toward an upper stop to close the slide fastener.

An opening operation of the slide fastener is as follows. After the slider 16 for upward opening is slid and put to the box 18, the reinforcing streak portion 6 is held to draw the separable pin 4 out of the box 18 and the slider 16 for upward opening to separate the slide fastener into the left and right fastener stringers 1, 1.

Figure 5:
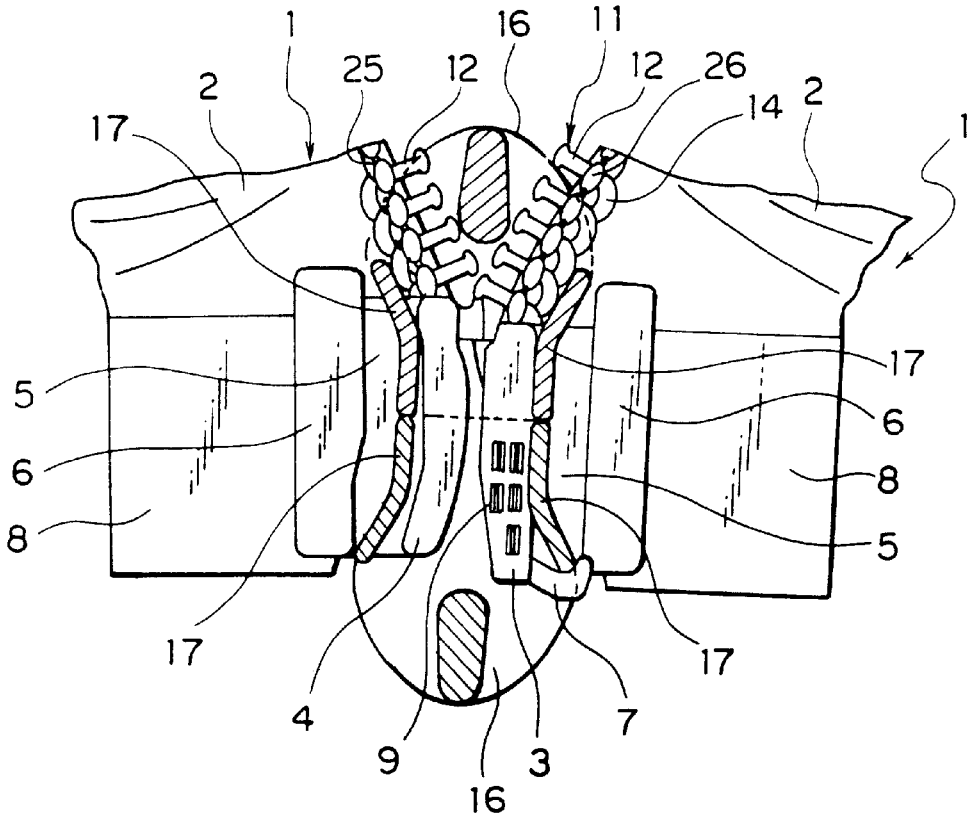
FIG. 5 is a front view of a reversely openable bottom end stop equipped with a slider for reverse opening with a portion cut.

Next, in the bottom end stop for reverse opening, the slider 16 for upward opening and the slider 16 for reverse opening may be slid and fitted over the fastener stringer 1 mounted with the box pin 3, as shown in FIG. 5. The same type of slider can be used for the slider 16 for upward opening and the slider 16 for reverse opening. The slider 16 for reverse opening is slid and fitted from the shoulder opening of the slider 16 for reverse opening from the upper stop side of the fastener stringer 1 mounted with the box pin 3 toward the box pin 3. The flange 17 of the slider 16 for reverse opening is inserted along the guide portion 5 to abut on the stopper 7 and is fitted. Then, the slider 16 for upward opening is slid and fitted over the fastener stringer 1 from a rear opening of the slider 16 and faces in a reverse orientation to the slider 16 for reverse opening, thereby completing the bottom end stop for reverse opening.

A reverse opening bottom end stop operation of the slide fastener is as follows. The slider 16 for reverse opening fitted over one of the fastener stringers 1 is slid until the flange 17 abuts on and stops at the stopper 7 extending from the box pin 3 to the reinforcing streak portion 6 and projecting on the guide portion 5. Then, the slider 16 for upward opening is slid and puts to the slider 16 for reverse opening until the slider 16 for upward opening slider 16 abuts on the slider 16 for reverse opening. In this state, the separable pin 4 of the other fastener stringer 1 is inserted from the shoulder opening of the slider 16 for upward opening and is inserted from the rear opening of the slider 16 for reverse opening until the separable pin 4 stops. After the insertion, the slider 16 for upward opening is slid toward the upper stop or the slider 16 for reverse opening is slid.

An opening operation of the slide fastener is as follows. The slider 16 for reverse opening is slid down to the stopper 7 or the slider 16 for upward opening is put to the slider 16 for reverse opening. Then, the separable pin 4 is drawn out of both the sliders 16, 16, thereby separating the slide fastener into the left and right fastener stringers 1, 1.

Figure 6:
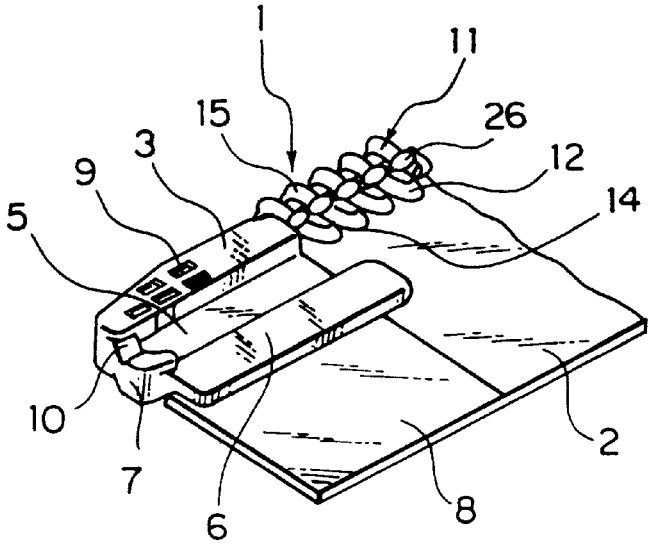
FIG. 6 is a perspective view of a fastener stringer showing a modification of a stopper.
Figure 7:
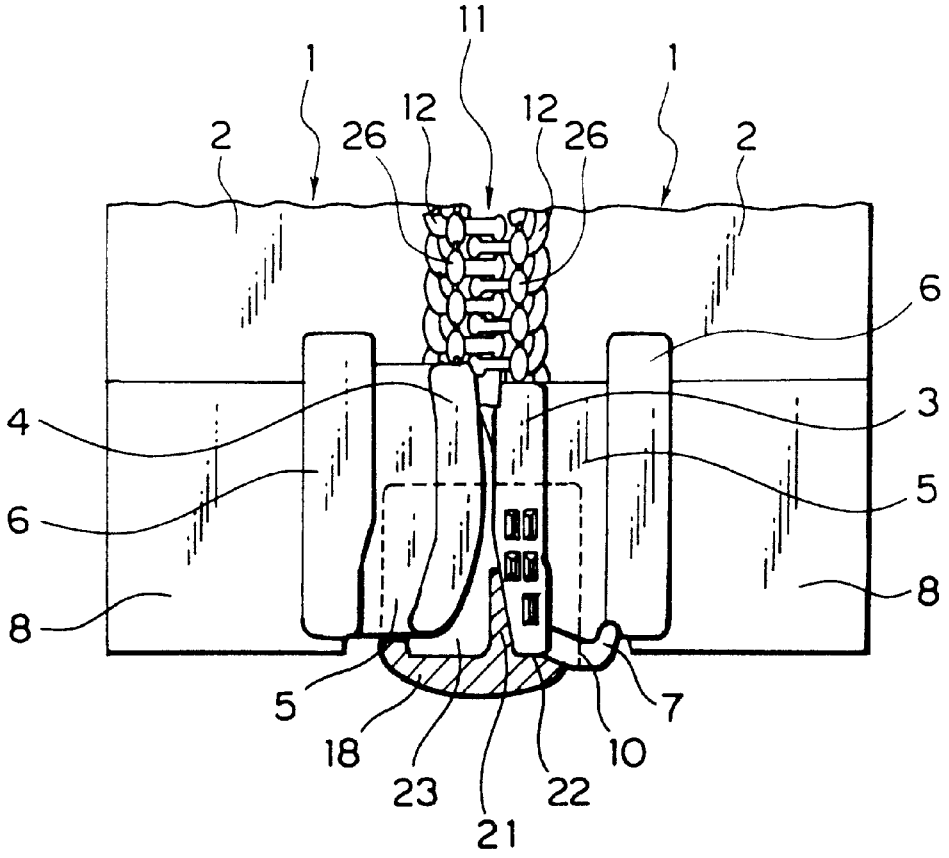
FIG. 7 is a front view of the fastener chain equipped with a box with a portion cut.

Next, a modification of the stopper in the bottom end stop is shown in FIG. 6. The stopper 7 laterally extending from the tip end of the box pin 3 to the tip end of the reinforcing streak portion 6 is defined at its intermediate portion with a stepped portion 10. The stepped portion 10 is characterized in that it is lower on a box pin 3 side and higher on a reinforcing streak portion 6 side. The box 18 is in the same form as that in the preceding example as shown in FIG. 7 and the box 18 is mounted through the similar steps. The inserting groove 21 defined in the flange 20 is pushed into the stopper 7 and the locking hole 24 defined at the deepest portion of the inserting groove 21 is fitted into the stopper 7. Then, ultrasonic machining is applied from an upper face of the box 18, thereby welding the small projections 9 on the upper face of the box pin 3 to fix the box 18 to the box pin 3.

Figure 8:
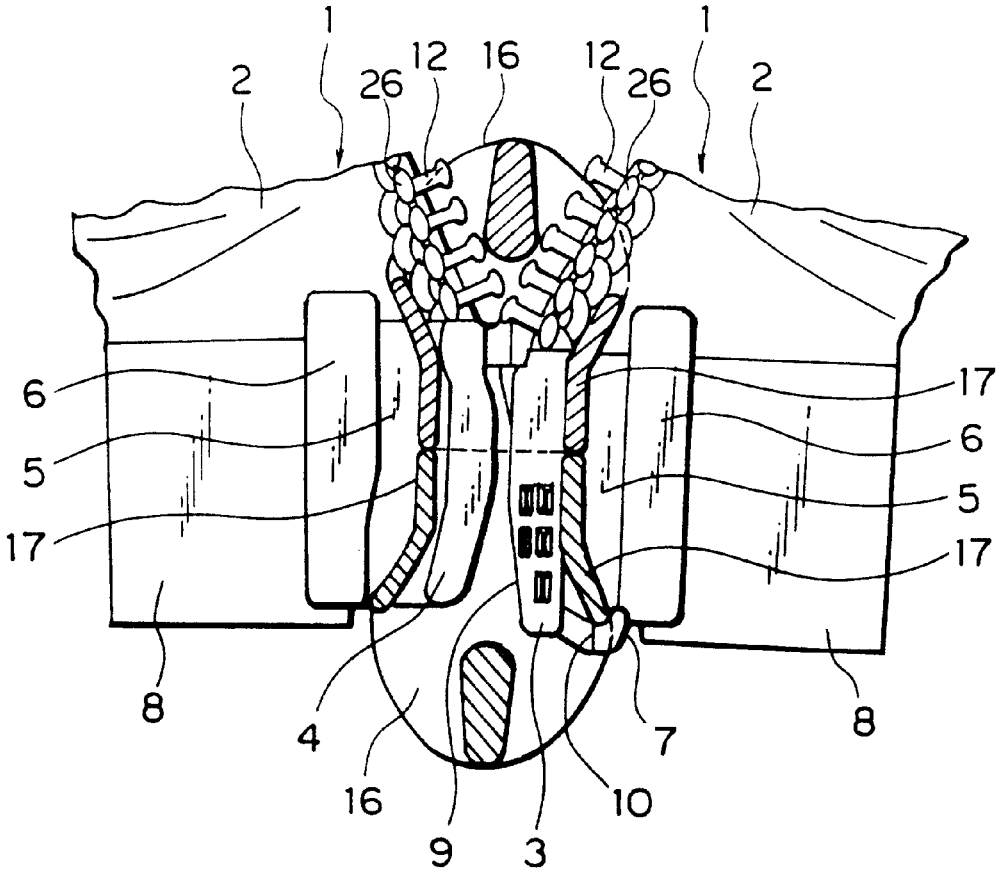
FIG. 8 is a front view of the fastener chain equipped with a slider for reverse opening with a portion cut.

When the slider 16 for reverse opening is slid and fitted over the fastener stringer 1 and the separable pin 4 is inserted into the slider 16 for reverse opening, the tip end of the flange 17 of the slider 16 for reverse opening is put to the projecting portion of the stopper 7, the projecting portion formed to be thick on the reinforcing streak portion 6 side, thereby properly and firmly retaining the slider 16 for reverse opening, as shown in FIG. 8.

Figure 10:
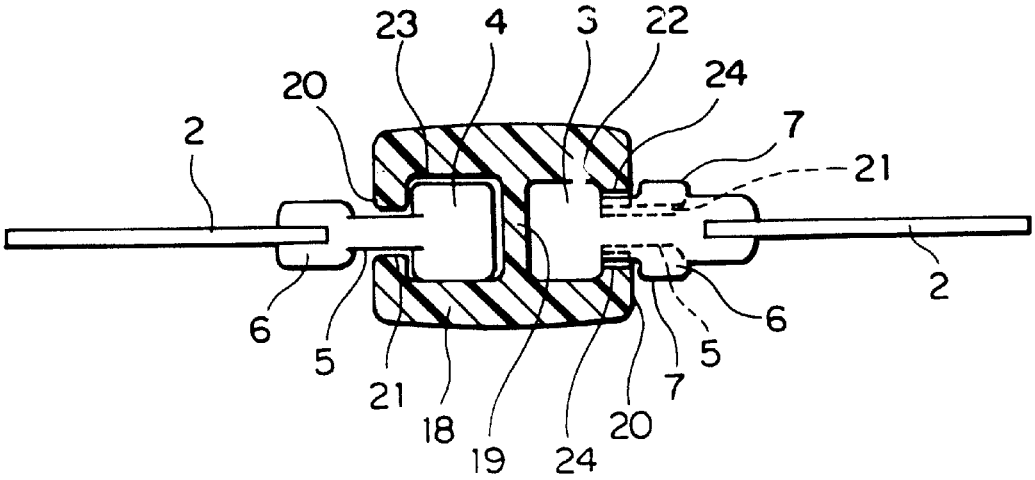
FIG. 10 is a bottom view of an essential portion by cutting out only the box of the bottom end stop of FIG. 9.
Figure 11:
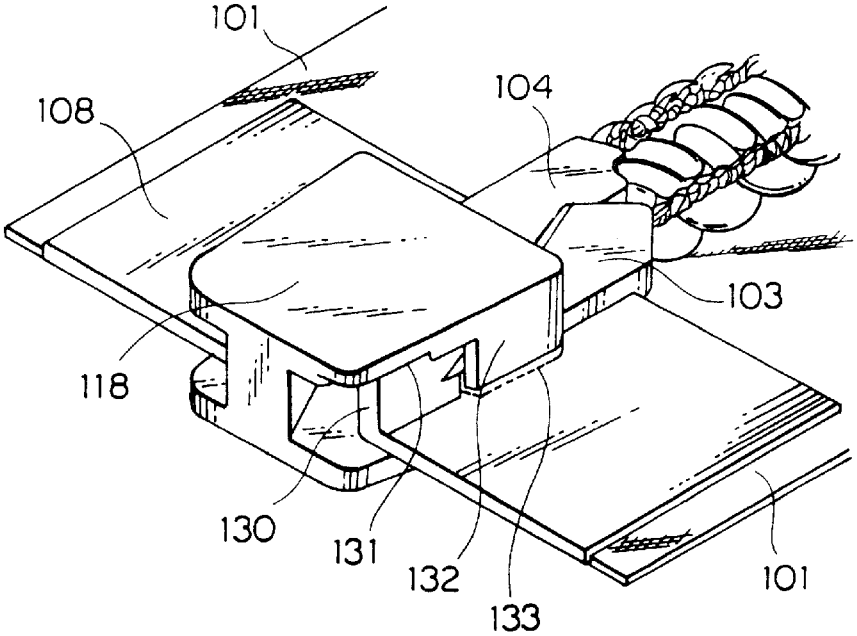
FIG. 11 (PRIOR ART)
FIG. 11 is a perspective view of a known bottom end stop of a slide fastener.
Figure 12:
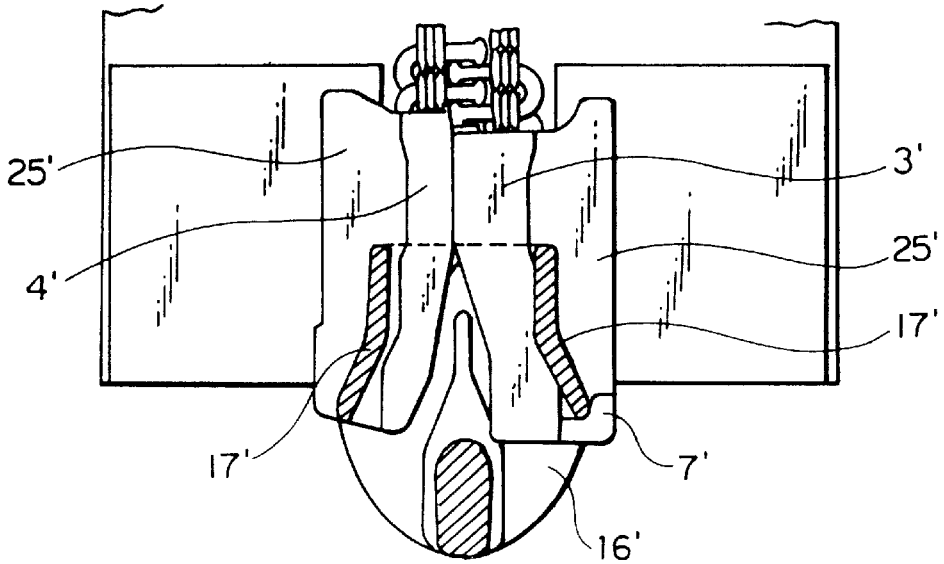
FIG. 12 (PRIOR ART)
FIG. 12 is a front view of a known bottom end stop for reverse opening with a portion cut.

Another modification of the bottom end stop will be described. As shown in FIGS. 10 and 11, the bottom end stop is suitable to a slide fastener, wherein fastener elements 13 which are single bodies projecting from opposite faces of each the fastener tape 2 are mounted to a longitudinal edge of each the fastener tape 2 as the fastener element 11. The bottom end stop is defined at the end portions of the left and right fastener stringers 1 with reinforcing portions 8 formed by welding thermoplastic resin films or the like to the fastener tapes 2 where the fastener elements 13 which are the single bodies are removed.

A box pin 3 connected to the single body fastener element 13 and having a rectangular shape in cross section is molded at the reinforcing portion 8 of one of the fastener stringer 1 so as to project from the surface and back face of the fastener tape 2. A guide portion 5, thinner than the box pin 3, which is adjacent to a side of the box pin 3 and has such a width that a flange 17 of the slider 16 for reverse opening can freely slide in the guide portion 5 is molded on the surface and back face of the fastener tape 2. A reinforcing streak portion 6 which is thinner than the box pin 3 and thicker than the guide portion 5 and is symmetric with respect to a fastener tape plane is molded in adjacent to a side of the guide portion 5 and on both front and back surfaces of the fastener tape 2. A stopper 7 which extends from the tip end of the box pin 3 to the tip end of the reinforcing streak portion 6, which is thinner on the box pin 3 side and as thick as the box pin 3 on the reinforcing streak portion 6 side, which is defined at its center with a stepped portion 10, and which projects in a V-shape is molded on a face of the guide portion 5 and on both front and back surfaces of the fastener tape 2.

A separable pin 4 connected to the single body fastener element 13 and having a rectangular shape in cross section is molded at the reinforcing portion 8 of the other fastener stringer 1 so as to project from the surface and back face of the fastener tape 2 as shown in FIG. 10, for example, similarly to the box pin 3. A thin and plate-shaped guide portion 5 which is adjacent to a side of the separable pin 4 and has such a width that a flange 17 of the slider 16 for reverse opening can freely slide in the guide portion 5 is molded on the surface and back face of the fastener tape 2. A reinforcing streak portion 6 which is thicker than the guide portion 5 and thinner than the separable pin 4 is formed in adjacent to a side of the guide portion 5, thereby forming the fastener stringer 1 equipped with the separable pin 4.

The box pin 3, guide portion 5, reinforcing streak portion 6, stopper 7 which are molded on the reinforcing portion 8 of the one fastener stringer 1 and the separable pin 4, guide portion 5, reinforcing streak portion 6 which are molded on the reinforcing portion 8 of the other fastener stringer 1 are integrally molded to be symmetric with respect to a fastener tape plane by injection molding processing or extrusion processing by using thermoplastic resin, respectively.

Figure 9:
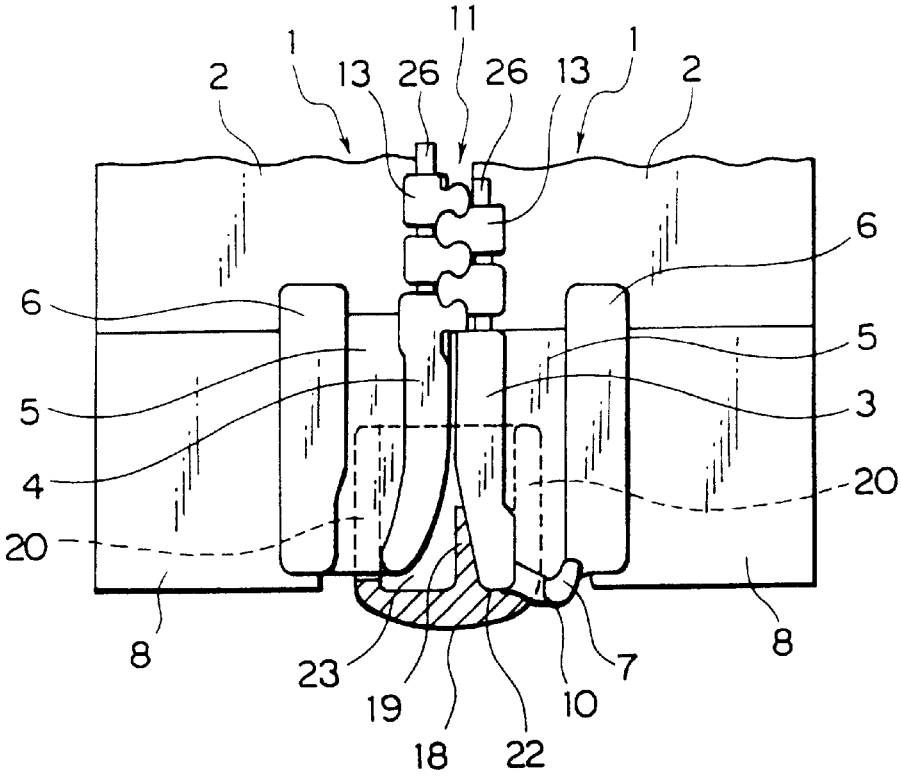
FIG. 9 is a front view of the fastener chain equipped with a bottom end stop which is symmetric with respect to a fastener tape plane with a portion cut.

The box 18 fitted over the box pin 3 has a substantially square outward form and is defined at centers of opposite flanges 20 with inserting grooves 21 which are slightly narrower than a thickness of the stopper 7 and into which the guide portions 5 can be inserted, as shown in FIGS. 9 and 10. A locking hole 24 which extends upward and downward and into which the stopper 7 can be fitted is formed at a deepest portion of the inserting groove 21 on the box pin 3 side.

The box 18 is mounted to the box pin 3 through the similar steps to the above respective examples. The inserting groove 21 defined in the flange 20 of the box 18 is put to and pushed into the stopper 7 and the stopper 7 is fitted into the locking hole 24 defined at the deepest portion of the inserting groove 21 and extending upward and downward. Then, the box 18 and the box pin 3 are welded and fixed to each other by ultrasonic machining or the like, thereby completing the upward opening type of bottom end stop.

By sliding and fitting the slider 16 for reverse opening and the slider 16 for upward opening which are symmetric with respect to the fastener tape plane over the fastener stringer 1 equipped with the box pin 3 in a state wherein the sliders 16 reversely face each other, the slide fastener comprising single body fastener elements 13 and having the bottom end stop for both-way opening can be easily completed. A bottom end stop operation can be carried out through the similar steps to the above example.

In the respective embodiments, it is preferable that the upper stop is mounted to the fastener stringer 1 after sliding and fitting the slider 16 for upward opening or the slider 16 for reverse opening over the fastener stringer 1.

The reversely openable bottom end stop of the slide fastener of the invention has the above-described structure and exhibits the following effects by the structure.

According to the invention stated in the first aspect, the box pin and the separable pin made of thermoplastic resin are respectively mounted to end portions of fastener stringers, thin guide portions are respectively formed at sides of the box pin and the separable pin, projecting reinforcing streak portions are integrally formed at sides of the guide portions, and the stopper extending from the tip end of the box pin to the tip end of the reinforcing streak portion and is formed on an upper face of the guide portion. Therefore, the normal slider, i.e., the slider of the same type as the slider for upward opening can be applied as the slider for reverse opening without using a slider in a special form. As the result, an upward opening type or the both-way opening type of slide fastener having the bottom end stop can be supplied in immediate response to demand, thereby improving productivity. Moreover, in the bottom end stop operation, the fastener stringers can be easily held to smoothly carry out the operation.

Since the stopper is in the V shape and projecting higher than the reinforcing streak portion, and the reinforcing streak portion projects from both front and back surfaces of the fastener tape, the slider for reverse opening fastens the bottom end stop sideways and is stopped properly at the end of the fastener chain and the fastener stringers can be further easily held.

As the guide portions formed at the sides of the box pin and the separable pin have such widths that at least flanges of the slider can slide in the guide portions, the box can be mounted without hindrance, the slider for reverse opening can stably slide at the end of the fastener chain, and the smooth bottom end stop operation or both-way opening operation can be carried out.

For the stopper laterally formed between the box pin and the reinforcing streak portion is defined at the intermediate portion of the stopper with the stepped portion and projects higher on the reinforcing streak portion side and lower on the box pin side, there is no hindrance to the locking function of the slider for reverse opening, the box can be easily connected to the box pin, and the bottom end stop can be easily produced.

The reinforcing portions are formed by welding thermoplastic resin films to the opposite faces of the end portions of the fastener tapes, the reinforcing streak portions are integrally molded on both front and back surfaces of the reinforcing portions, and the box pin, the guide portion, and the stopper, or the separable pin and the guide portion are respectively and integrally molded on the face of the reinforcing portion. Therefore, the end portion of the fastener chain wherein the fastener elements are mounted to the one faces of the fastener tapes is reinforced, the end portion of the fastener chain can be easily held, and the bottom end stop operation and the both-way opening operation can be carried out smoothly.

Since the reinforcing portions are formed by welding thermoplastic resin films to the opposite faces of the end portions of the fastener tapes, the box pin, the guide portion, the stopper, and the reinforcing streak portion, or the separable pin, the guide portion, and the reinforcing streak portion are respectively and integrally molded on both front and back surfaces of the reinforcing portion so as to be symmetric with respect to the fastener tape plane, the end portion of the fastener chain wherein the fastener elements are formed on the opposite faces of the fastener tapes is reinforced, the end portion of the fastener chain can be easily held, and the bottom end stop operation and the both-way opening operation can be carried out smoothly.

The box is substantially square and defined at the center of the box with the partitioning portion, the box pin insertion hole is formed at one side of the partitioning portion, the separable pin insertion hole is formed at the other side of the partitioning portion, inserting grooves for the fastener tapes are formed at side portions of the box pin insertion hole and the separable pin insertion hole, the locking hole which is for the stopper and is wider than the inserting grooves is connected to the tip end of the inserting groove of the box pin insertion hole of the box, the box pin is fitted into the box, the stopper is locked in the locking hole, and opposed faces of the box and the box pin are welded to each other. Therefore, the box can be firmly fixed to the end portion of the fastener stringer and the strong bottom end stop can be produced easily.

As the slider for reverse opening and the slider for upward opening are slid and fitted over the fastener stringer mounted with the box pin so as to face each other reversely, and the tip end of the flange of the slider for reverse opening can abut on the stopper formed to project from the face of the guide portion, the convenient slide fastener for both-way opening wherein the slider for upward opening and the slider for reverse opening are slid and fitted over the fastener stringer and the slider for reverse opening has such a function that the slider can be stopped by using the tip end of the flange can be produced easily. As described above, the invention exhibits extremely remarkable effects.

What is claimed:

1. A reversely openable bottom end stop of a slide fastener, wherein a box pin and a separable pin made of thermoplastic resin are respectively mounted to end portions of fastener stringers, thin guide portions are respectively formed at sides of said box pin and said separable pin, projecting reinforcing streak portions are integrally formed at sides of said guide portions, and a stopper extending from a tip end of said box pin to a tip end of said reinforcing streak portion is formed on an upper face of said guide portion.

2. A reversely openable bottom end stop of a slide fastener according to claim 1, wherein said stopper is in a V shape and projecting higher than said reinforcing streak portion, and said reinforcing streak portion projects from both front and back surfaces of a fastener tape.

3. A reversely openable bottom end stop of a slide fastener according to claim 1, wherein said guide portions formed at said sides of said box pin and said separable pin have such widths that at least flanges of a slider can slide in said guide portions.

4. A reversely openable bottom end stop of a slide fastener according to claim 1, wherein said stopper laterally formed between said box pin and said reinforcing streak portion is defined at an intermediate portion of said stopper with a stepped portion and projects higher on a reinforcing streak portion side and lower on a box pin side.

5. A reversely openable bottom end stop of a slide fastener according to claim 1, wherein reinforcing portions are formed by welding thermoplastic resin films to opposite faces of end portions of said fastener tapes, said reinforcing streak portions are integrally molded on both front and back surfaces of said reinforcing portions, and said box pin, said guide portion, and said stopper, or said separable pin and said guide portion are respectively and integrally molded on a face of said reinforcing portion.

6. A reversely openable bottom end stop of a slide fastener according to claim 1, wherein reinforcing portions are formed by welding thermoplastic resin films to opposite faces of end portions of said fastener tapes, said box pin, said guide portion, said stopper, and said reinforcing streak portion, or said separable pin, said guide portion, and said reinforcing streak portion are respectively and integrally molded on both front and back surfaces of said reinforcing portion so as to be symmetric with respect to a fastener tape plane.

7. A slide fastener having a bottom end stop according to claim 1, wherein a box is substantially square and defined at a center of said box with a partitioning portion, a box pin insertion hole is formed at one side of said partitioning portion, a separable pin insertion hole is formed at the other side of said partitioning portion, inserting grooves for said fastener tapes are formed at side portions of said box pin insertion hole and said separable pin insertion hole, a locking hole which is for said stopper and is wider than said inserting grooves is connected to a tip end of said inserting groove of said box pin insertion hole, said box pin is fitted into said box, said stopper is locked in said locking hole, and opposed faces of said box and said box pin are welded to each other.

* * * * *

UNITED STATES PATENT AND TRADEMARK OFFICE

CERTIFICATE OF CORRECTION

PATENT NO. : 6,195,852 B1
DATED : March 6, 2001
INVENTOR(S) : Masahiro Kusayam

It is certified that error appears in the above-identified patent and that said Letters Patent is hereby corrected as shown below:

Claim 8,

Please insert as follows:

-- 8. A slide fastener for both-way opening according to claim 1, wherein a slider for reverse opening and said slider for upward opening are slid and fitted over said fastener stringer mounted with said box pin so as to face each other reversely, and a tip end of flange of said slider for reverse opening can abut on said stopper formed to project from a face of said guide portion. --

Signed and Sealed this

Fourth Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,195,852 B1
DATED : March 6, 2001
INVENTOR(S) : Masahiro Kusayam

It is certified that error appears in the above-identified patent and that said Letters Patent is hereby corrected as shown below:

Claim 8,
Please insert as follows:
-- 8. Aslide fastener for both-way opening according to claim 1, wherein a slider for reverse opening and said slider for upward opening are slid and fitted over said fastener stringer mounted with said box pin so as to face each reversely, and a tip end of a flange of said slider for reverse opening can abut on said stopper formed to project from a face of said guide portion. --

Signed and Sealed this

Twenty-fifth Day of June, 2002

*Attest:*

*Attesting Officer*

JAMES E. ROGAN
*Director of the United States Patent and Trademark Office*